US005711022A

United States Patent [19]

Steenwyk

[11] Patent Number: 5,711,022

[45] Date of Patent: Jan. 20, 1998

[54] STARTING POSITION CONTROL FOR DEMOLITION APPARATUS

[75] Inventor: Timothy E. Steenwyk, Grand Rapids, Mich.

[73] Assignee: Laser Alignment, Inc., Grand Rapids, Mich.

[21] Appl. No.: 572,090

[22] Filed: Dec. 14, 1995

[51] Int. Cl.[6] ..... E04G 23/00; E04G 23/08

[52] U.S. Cl. ..... 701/50; 701/300; 340/680

[58] Field of Search ..... 364/424.07, 460, 364/561, 474.34, 474.35, 167.01; 173/1; 340/680, 685, 686; 414/738, 739

[56] References Cited

U.S. PATENT DOCUMENTS

| | | | |
|---|---|---|---|
| 4,113,033 | 9/1978 | Lindblad | 173/1 |
| 4,205,308 | 5/1980 | Haley et al. | 340/686 |
| 4,332,517 | 6/1982 | Igarashi et al. | 414/699 |
| 4,377,043 | 3/1983 | Inui et al. | 37/18 R |
| 4,633,383 | 12/1986 | Omachi et al. | 364/167 |
| 4,698,570 | 10/1987 | Satoh | 318/568 |
| 4,712,624 | 12/1987 | Mashimo | 173/43 |
| 4,829,418 | 5/1989 | Nielsen et al. | 364/167.01 |
| 4,833,615 | 5/1989 | Bitner et al. | 364/463 |
| 4,866,641 | 9/1989 | Nielsen et al. | 364/559 |
| 4,910,673 | 3/1990 | Narisawa et al. | 364/424.07 |
| 5,011,358 | 4/1991 | Andersen et al. | 414/273 |
| 5,065,326 | 11/1991 | Sahm | 364/424.07 |
| 5,088,020 | 2/1992 | Nishida et al. | 364/160 |
| 5,160,239 | 11/1992 | Allen et al. | 414/699 |
| 5,196,998 | 3/1993 | Fulton | 364/167.01 |
| 5,208,753 | 5/1993 | Acuff | 364/424.07 |
| 5,257,177 | 10/1993 | Bach et al. | 364/167.01 |

FOREIGN PATENT DOCUMENTS

| | | |
|---|---|---|
| 0404229A2 | 12/1990 | European Pat. Off. . |
| 0404229A3 | 12/1990 | European Pat. Off. . |

*Primary Examiner*—Michael Zanelli

*Attorney, Agent, or Firm*—Van Dyke, Gardner, Linn & Burkhart, LLP

[57] ABSTRACT

A method and apparatus for demolishing a structure is disclosed. A crusher member (12) is provided supported by a support frame (14). A reference position vertically above an operator is established. The relative distance between the crusher member (12) and the reference position in a generally vertical direction is monitored. The crusher member (12) is guided to the reference position as a function of the relative distance in order to prepare for a demolition cycle of removing a portion of the structure. The crusher member (12) is then manually manipulated through a demolition cycle.

25 Claims, 4 Drawing Sheets

STARTING POSITION CONTROL FOR DEMOLITION APPARATUS

BACKGROUND OF THE INVENTION

This invention relates generally to a demolition apparatus and a method of demolishing a structure and, in particular, to an apparatus and method utilizing a crusher member which is positioned to a vertical height above an operator by an elongated member in order to crush and remove portions of structures.

A crusher type of demolition apparatus utilizes an articulated crushing jaw member supported from a base member by a connecting member, or series of articulated connecting members. The base member, typically, is capable of movement along the ground surface as by treads, or the like. Such articulated connecting members are pivotally movable with respect to each other by hydraulic cylinders or the like. An operator, sitting in a cab on the base member, manipulates hydraulic valves in order to position the crushing member, with the jaws of the crushing member straddling a beam or other portion of the structure. The crushing member jaws are then closed in order to sever the beam or other portion of the structure. The loose debris is then carried by the crushing member to a dump truck or other receptacle. Such crusher jaw demolition is desirable because it simultaneously demolishes the structure and removes the debris in relatively small pieces. It does so with minimal dust and without requiring an extensive safety zone around the structure.

One difficulty with such crusher jaw demolition is that the crusher member jaws must be repositioned after each debris removal cycle at a location on the structure which is typically much higher than the elevation of the operator in the cab. It is difficult for the operator to judge the relative height between the crusher member and the desired portion of the structure and to align the crusher member with this portion of the structure. Therefore, much time is wasted juxtaposing the crusher member with the desired portion of the structure. Additionally, this manipulation is performed with the operator looking upwardly, which creates strain and fatigue in the operator. This further slows the operation, and a buildup in operator fatigue may result in a dangerous condition.

SUMMARY OF THE INVENTION

The present invention provides a method and apparatus for controlling a hydraulic crusher having a base member, a crusher member, and a connecting member interconnecting the crushing member with the base member and for using such apparatus to demolish a structure. The relative position of the crusher member with respect to the connecting member and the relative position of the connecting member with respect to the base member are monitored in order to determine the generally vertical height of the crusher member with respect to the base member. This information regarding the height of the crusher member is utilized to guide the crusher member to a reference height starting position.

An operator display panel may be provided in order to display the height of the crusher member relative to the reference height starting position. The operator display panel may be utilized by the operator to manually guide the crusher member to the reference height starting position. Alternatively, a manual input may be provided for receiving an operator control of the connecting member with respect to the base member with the movement of the crushing member being automatically controlled in a manner which guides the crushing member to the reference height starting position. In yet an additional embodiment, the relative positions of the connecting member with respect to the base member and the crusher member with respect to the connecting member are automatically controlled in order to guide the crusher member to return to a reference height starting position.

The present invention provides a unique method for demolishing a structure by positioning of the crusher member prior to commencement of the crushing operation. The crushing operation is, per se, under the manual control of the operator to actually carry out the demolition. By prepositioning the crushing member, the demolition cycle is shortened because less time is required for the prepositioning operation. Furthermore, by accurately guiding the crusher member at a reference height starting position, a source of operator stress and fatigue is substantially eliminated. Once the crusher member is properly positioned, the remaining portion of the cycle is more effortlessly carried out by the operator because the relative position of the crusher member and the structure has been established.

These and other objects, advantages, and features of this invention will become apparent upon review of the following specification in conjunction with the drawings.

DESCRIPTION OF THE PREFERRED EMBODIMENT

Figure 1:
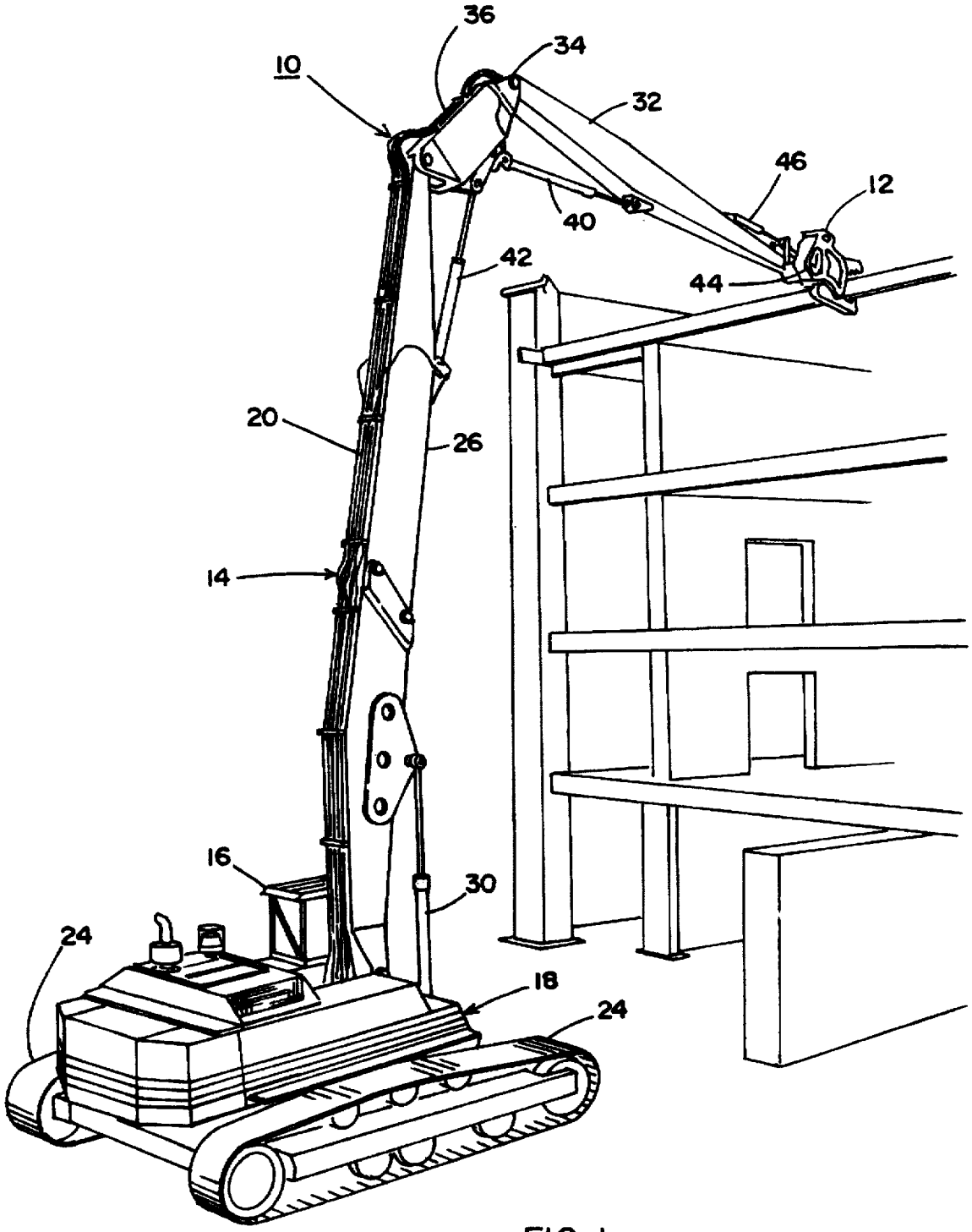
FIG. 1 is perspective view of a crushing jaw demolition apparatus, according to the invention, in operation demolishing a structure.

Referring now specifically to the drawings and the illustrative embodiments depicted therein, a demolition apparatus 10 includes a crusher member 12 which is supported by a support frame 14 for operation generally above the operator (not shown) positioned in a cab 16 (FIG. 1). Support frame 14 includes a base member 18 and a connecting member 20 which interconnects crusher member 12 with base member 18. In the illustrated embodiment, base member 18 includes a body 22 which is mounted for lateral traversal of terrain by a pair of propulsion treads 24. Body 22 is pivotally mounted for rotating about a vertical axis. Cab 16 is mounted to body 22. Connecting member 20 includes a boom 26, which is pivotally mounted at 28 to body 22 and is rotated about pivot 28 by an actuator 30 which, in the illustrated embodiment, is a hydraulic cylinder. A stick 32 is pivotally mounted at 34 to an intermediate member 36 which, in turn, is pivotally mounted at 38 to boom 26. An actuator 40 rotates stick 32 about pivot 34 and an actuator 42 rotates intermediate member 36 about pivot 38. In the illustrated embodiment, actuators 40 and 42 are hydraulic cylinders. Crusher member 12 is pivotally mounted at 44 to a distal end of stick 32 and is rotated about pivot 44 by an actuator 46, which, in the illustrated embodiment, is a hydraulic cylinder.

Crusher member 12 includes a lower jaw 48 and an upper jaw 50 which are selectively brought together in a shearing fashion by an actuator (not shown). In the illustrated embodiment, crusher member 12 may be a concrete shear, a scrap shear, a wood shear or a combination shear of the type manufactured by Verachtert BV in Hertogenbosch, The Netherlands. Crusher member 12 may include a universal basis yoke in order to accommodate rotational motion of the jaw members with respect to the long axis of stick 32. In the illustrated embodiment, support frame 14 is a hydraulic excavator with crusher member 12 mounted thereto as an auxiliary attachment. As such, the crusher member hydraulic inputs are connected with accessory ports of the hydraulic system of support frame 14.

Figure 2:
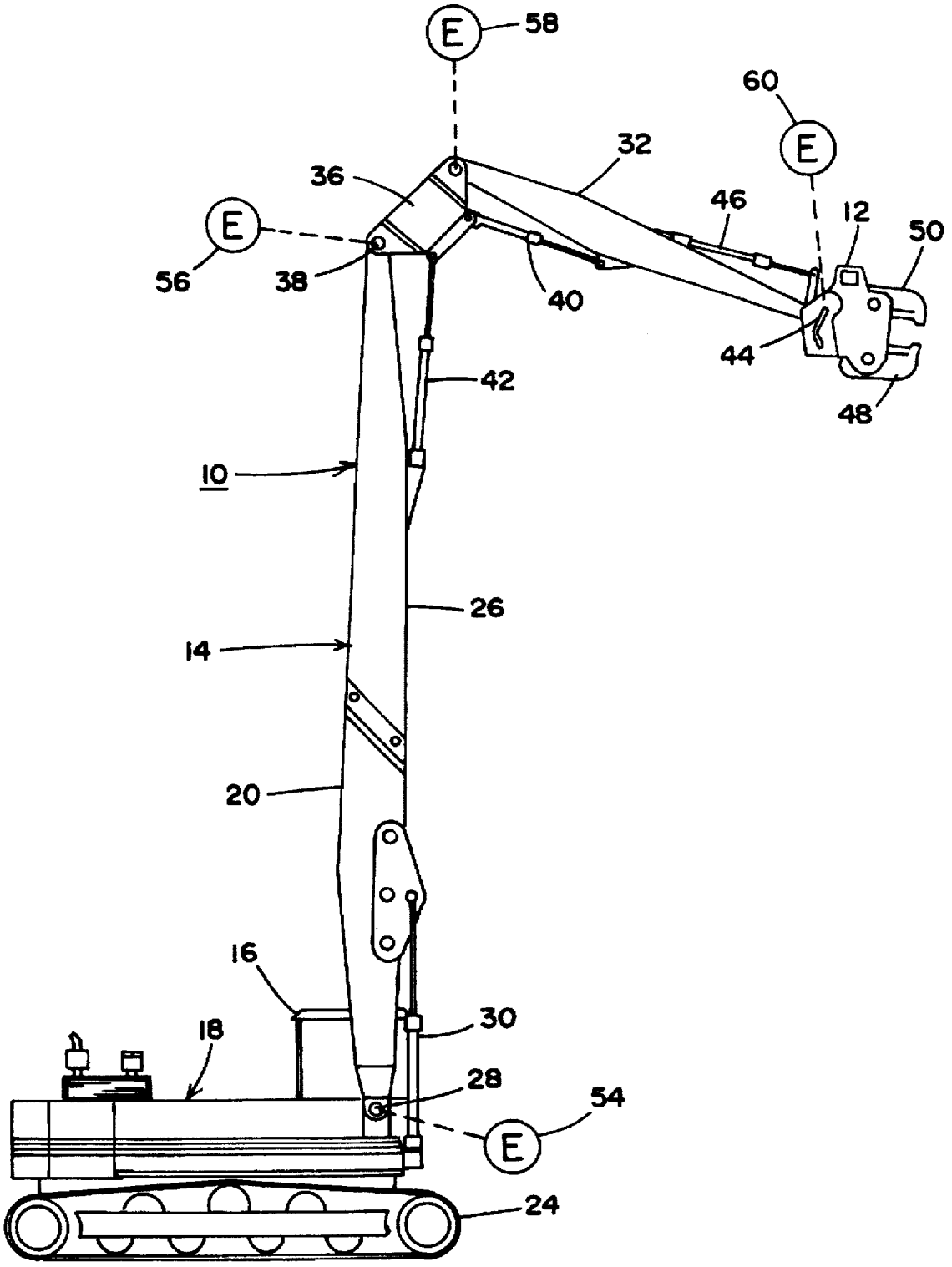
FIG. 2 is a side elevation of the crushing jaw demolition apparatus in FIG. 1.
Figure 3:
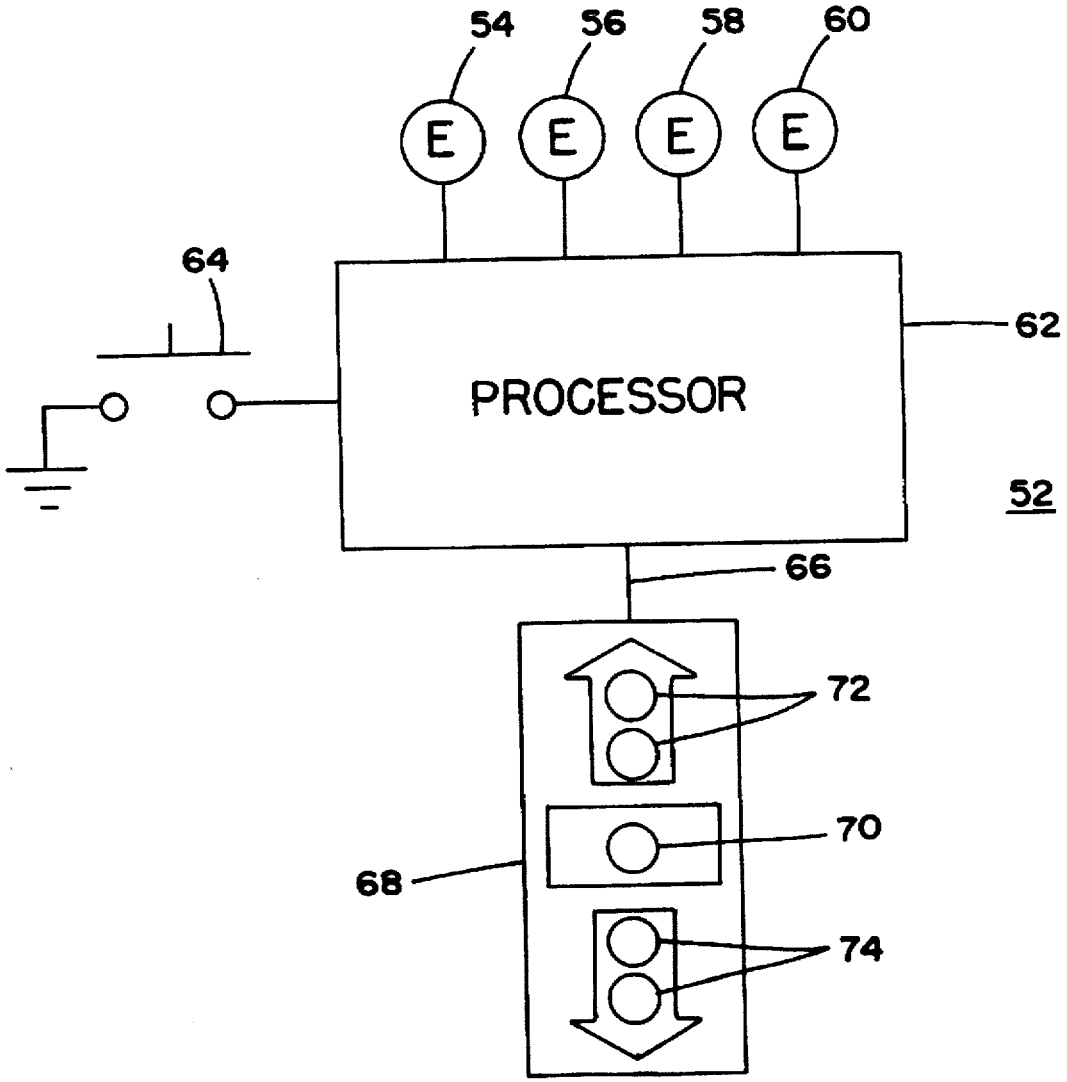
FIG. 3 is a block diagram of a control system, according to the invention.

Demolition apparatus 10 includes a control system 52 including a first monitor 54 for monitoring movement of boom 26 with respect to base member 18, a second monitor 56 for monitoring motion of intermediate member 36 with respect to boom 26, a third monitor 58 for monitoring movement of stick 32 with respect to intermediate member 36, and a fourth monitor 60 for monitoring movement of crusher member 12 with respect to stick 32 (FIGS. 2 and 3). In the illustrated embodiment, monitors 54–60 are rotary encoders which mount directly to the monitored pivot and produce a digital electrical output signal indicative of the angle, or change in angle, between the monitored member and the reference member. Such rotary encoder is marketed by Hecon Corporation of Germany under Model No. RI41-0/3600 AR.11KB.

Each monitor 54–60 supplies an input to a control processor 62 which additionally receives an input from an operator switch 64. Processor 62 includes an output 66 to a display panel 68 preferably located in cab 16. Operator switch 64 is preferably a foot switch positioned in cab 16 for operation by the operator's foot, but could additionally be a hand-operated switch or other user operable control device. Display panel 68 includes a "center" or "aligned" indicator 70, one or more "go up" indicators 72, and one or more "go down" indicators 74.

In operation, in order to begin demolition of a structure, the operator manipulating manual levers (not shown) guides crusher member 12 manually to a desired starting position, as illustrated in FIG. 1. Encoders 54–60 monitor the relative position of the crusher member with respect to the support frame and the relative positions of the members making up the support frame. From the inputs provided by encoders 54–60 and the known geometry of the support frame members, processor 62 calculates, on a repetitive basis, a relative generally vertical location of crusher member 12. Such calculation is disclosed in U.S. Pat. No. 4,829,418 for an APPARATUS AND METHOD FOR CONTROLLING A HYDRAULIC EXCAVATOR, the disclosure of which is hereby incorporated herein by reference. When the operator has positioned crasher member 12 in a desired starting position, operator switch 64 is actuated. This causes processor 62 to store the relative vertical position of crusher member 12 when switch 64 is closed, as a reference, or datum, height. After a portion of debris is loosened from the structure, the operator manipulates the demolition apparatus in order to lower the crusher member, clutching the removed debris, in order to deposit the debris into a receptacle, such as a dump truck or the like.

In order to rapidly and easily return crusher member 12 to the datum position illustrated in FIG. 1, the operator manipulates the manual hydraulic controls while observing display panel 68. While crusher member 12 is below the datum, "go up" indicator 72 will be illuminated. As upward movement of the crusher member causes coincidence with the datum, "center," or "aligned," indicator 70 will become illuminated. If the operator overshoots the datum, "go down" indicator 74 will become illuminated. The operator should be able to vertically stabilize the crusher member on the datum and, thereby, keep the center indicator 70 illuminated. The operator can then move crusher member 12 in a generally horizontal direction, while maintaining approximate vertical alignment with the datum set by switch 64, to a desired demolition position.

The primary difficulty experienced by the operator of a crusher member demolition apparatus is locating the vertical height of the desired starting position for demolition. This is believed to be a result of the strain required by an upward gaze by the operator as well as a difficulty in obtaining a visual reference for gauging distances. In contrast, movement in a generally horizontal direction is not as difficult for an operator. However, if it is desired to assist in establishing both a generally horizontal datum as well as the generally vertical datum for a starting location, the relative horizontal position of crusher member 12 may be calculated by processor 62 according to techniques disclosed in U.S. Pat. No. 4,829,418. A "center" or "aligned" horizontal indicator and "close" and "far" horizontal indicators (not shown) could be additionally located on panel 68 in order to indicate the relative generally horizontal position of crusher member 12 with respect to a horizontal datum. Such horizontal datum would be established in a horizontal direction fore and aft of body 22 when operator switch 64 is actuated.

Figure 4:
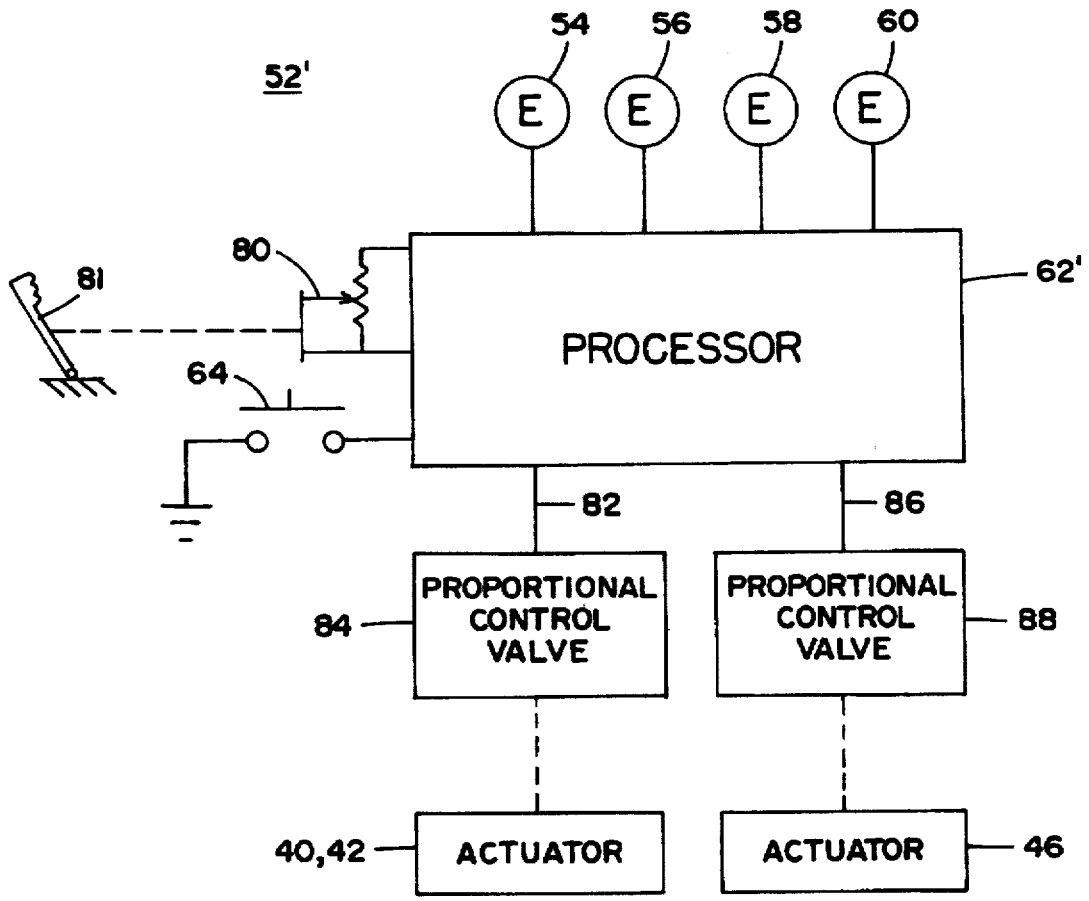
FIG. 4 is a block diagram of a control system of an alternative embodiment of the invention.

In an alternative embodiment, a control system 52' includes a processor 62' receiving inputs from encoders 54–60 (FIG. 4). In addition to an input from operator switch 64, control 62' receives an input signal from a monitor switch 80. Monitor switch 80 monitors a manual lever 81 manipulated by the operator to control the hydraulic valve which controls actuation of actuator 30. Actuator 30 manipulates the position of boom 26 with respect to base member 18. Processor 62' establishes a datum upon actuation of operator switch 64 in the same manner as does control system 52. Processor 62' produces an output 82 to a proportional control valve 84 controlling the flow of hydraulic fluid to actuators 40 and 42 which manipulate the relative position of stick 32 with respect to boom 26. Processor 62' additionally produces an output 86 to a proportional control valve 88 which controls the supply of hydraulic fluid to actuator 46, which manipulates the relative position of crusher member 12 with respect to stick 32.

In operation, processor 62' establishes a datum in the manner previously described by positioning crusher member 12 at a particular location and actuating input switch 64. Processor 62' computes the difference in generally vertical height between the relative position of crusher member 12 and the datum utilizing the principles disclosed in U.S. Pat. No. 5,572,809 issued to Timothy E. Steenwyk and Eric J. Walstra, for a CONTROL FOR HYDRAULICALLY OPERATED CONSTRUCTION MACHINE HAVING MULTIPLE TANDEM ARTICULATED MEMBERS, the disclosure of which is hereby incorporated herein by reference. As the operator moves manual lever 81 to control the hydraulic valve which manually operates boom 26 through actuator 30, the lever movement is monitored by the input from monitor switch 80. Processor 62' responds to the manual movement of boom 26 under control of the operator by producing signals to outputs 82 and 86 in order to operate actuators 40, 42, and 46 in a manner which moves crusher member 12 vertically to the datum entered through operator switch 64. This results in a combined partially manual and partially automatic control in which the operator controls the boom and the control automatically responds by positioning the stick and the crusher member. Of course, the manual control could be applied to the stick, with the boom and crusher member automatically controlled.

Alternatively, processor 52' could monitor, through the input from monitor switch 80, the operator movement of a lever 81 which is not connected with a hydraulic valve. The processor could calculate necessary movement in all portions of connecting member 20 and automatically operate a proportional control valve (not shown) to control operation of actuator 30. Control valves 84 and 88 would operate as previously described. In this manner, the control system would automatically control movement of the entire support frame in response to operator inputs and the inputs of encoders 54–60. Such embodiment may additionally include a provision wherein the operator is provided manual control over the apparatus when the crusher member is outside of a first, large predefined window defined around the reference starting position and automatic control of the crusher member is provided by the apparatus whenever the crusher member just within this window. When the crusher member is automatically moved to within a second, smaller, window defined around the reference starting position within the first window, manual control is returned to this operator. In this manner, the operator has manual control over the location of the crusher member when the crusher member is either far away from the demolition zone or at the demolition zone. However, the control automatically guides the crusher member to the demolition zone.

In addition to accepting operator inputs through an operator switch 64, the invention comprehends entry of an absolute vertical reference entered through an operator control panel for positioning of crusher member 12 by support frame 14. The invention additionally comprehends the inclusion of a tilt sensor for monitoring the tilt of base member 18 in order to more accurately determine an absolute height reference.

Monitoring of the motion of the crusher member with respect to the support frame and movement of the various members making up the support frame may be by other monitors such as inclination sensors on each of the members, or monitors which monitor the extension of each of the actuators in order to determine relative angular position of the members as disclosed in U.S. Pat. No. 4,866,641 for an APPARATUS AND METHOD FOR CONTROLLING A HYDRAULIC EXCAVATOR, the disclosure of which is hereby incorporated herein by reference. Direct monitoring of the vertical height of crusher member 12, such as by an altimeter, a reflected beam distance measuring system, global positioning system, or the like, is also comprehended by the invention. Additionally, the crusher member may be supported by a support frame made up of any combination of articulated and/or extendable members of the type known in the art, in order to support the crusher member for selective positioning in three dimensions.

Changes and modifications in the specifically described embodiments can be carried out without departing from the principles of the invention, which is intended to be limited only by the scope of the appended claims, as interpreted according to the principles of patent law including the doctrine of equivalents.

The embodiments of the invention in which an exclusive property or privilege is claimed are defined as follows:

1. A method of demolishing a structure comprising:

providing a crusher member supported by a support frame;

establishing a reference position vertically above an operator;

monitoring the relative distance between said crusher member and said reference position in a generally vertical direction;

guiding said crusher member to said reference position as a function of said relative distance by providing an operator display of said relative distance in order to prepare for a demolition cycle of removing a portion of said structure; and manually manipulating said crusher member through said demolition cycle.

2. The method of claim 1 wherein said establishing a reference position includes receiving an operator input when said crusher member is at a desired position.

3. The method of claim 2 including manually manipulating said crusher member to said desired position.

4. The method of claim 1 wherein said guiding includes manually manipulating a portion of said support frame and automatically controlling another portion of said support frame in response to movement of said portion and to said relative distance.

5. A hydraulic crusher apparatus, comprising:

a base member, a crusher member and a connecting member interconnecting said crusher member with said base member;

a first monitor for monitoring the relative positioning of said crusher member with respect to said connecting member and a second monitor for monitoring the relative positioning of said connecting member with respect to said base member; and a control that is responsive to said first and second monitors for determining a height of said crusher member with respect to said base member in order to guide said crusher member to return to a reference height above said base member.

6. The apparatus in claim 5 wherein said control includes a manual input for receiving a user input, wherein said control is responsive to said manual input for positioning said connecting member with respect to said base member and is responsive to said first and second monitors for positioning said crusher member at said reference height.

7. The apparatus in claim 6 wherein said control includes an operator display panel displaying the height of said crusher member relative to said reference position.

8. The apparatus in claim 5 wherein said control includes an operator display panel displaying the height of said crusher member relative to said reference position.

9. The apparatus in claim 5 wherein each said monitor includes a rotary encoder.

10. A method of controlling a hydraulic crusher having a base member, a crusher member, and a connecting member interconnecting said crusher member with said base member, including:

monitoring the relative position of said crusher member to said connecting member and the relative position of said connecting member to said base member; and determining a height of said crusher member with respect to said base member as a function of said position of said crusher member with respect to said connecting member and the relative position of said connecting member with respect to said base member; and guiding said crusher member to return to a reference height starting position.

11. The method of claim 10 wherein said guiding of said crusher member includes receiving a manual input for manipulating the position of said connecting member with respect to said base member and controlling the position of said crusher member with respect to said connecting member.

12. The method of claim 11 including displaying said height of said crusher member to an operator.

13. The method of claim 10 including displaying said height of said crusher member to an operator.

14. The method of claim 10 including receiving an operator selection of said reference height starting position.

15. The method of claim 10 wherein said receiving includes providing said operator with an input device and determining the height of said crusher member when said operator is actuating said input device.

16. The method of claim 15 wherein said providing an input device includes providing a foot switch.

17. The method of claim 10 further including determining a generally horizontal distance of said crusher member with respect to said base member as a function of said position of said crusher member with respect to said connecting member and said relative position of said connecting member with respect to said base member.

18. A hydraulic crusher apparatus, comprising:

a base member, a boom pivotally connected to said base member, a stick pivotally connected to said boom, and a pivoting jaw crusher member pivotally connected to said stick;

a first monitor for a relative position of said crusher member with respect to said stick, a second monitor for a relative position of said stick with respect to said boom, and a third monitor for a relative position of said boom and said base member; and a control that is responsive to said monitors for determining a height of said crusher member with respect to said base member in order to guide said crusher member to return to a reference starting height above said base member.

19. The apparatus in claim 18 wherein said control includes a manual input for receiving a user input, wherein said control is responsive to said manual input for positioning said boom with respect to said base member and is responsive to said first, second and third monitors for positioning said crusher member at said reference start position.

20. The apparatus in claim 19 wherein said control includes an operator display panel displaying the height of said crusher member relative to said reference position.

21. The apparatus in claim 18 wherein said control includes an operator display panel displaying the height of said crusher member relative to said reference position.

22. The apparatus in claim 18 wherein each said monitor includes a rotary encoder.

23. The apparatus in claim 18 including an input device for receiving an operator selection of said reference height starting position and wherein said control determines said height of said crusher member when said input device is actuated.

24. The apparatus in claim 23 wherein said input device is a foot switch.

25. The apparatus in claim 18 wherein said control also determines a generally horizontal distance of said crusher member with respect to said base member as a function of said relative position of said crusher member with respect to said stick, said relative position of said stick with respect to said boom and said relative position of said boom with respect to said base member.

* * * * *